US012674473B2

(12) United States Patent
Chen

(10) Patent No.: US 12,674,473 B2
(45) Date of Patent: Jul. 7, 2026

(54) HANDHELD REFRIGERATION FAN

(71) Applicant: Shenzhen Weiteshijia Technology Co., Ltd, Shenzhen (CN)

(72) Inventor: Yan Chen, Huilai (CN)

(73) Assignee: Shenzhen Weiteshijia Technology Co., Ltd, Shenzhen (CN)

( * ) Notice: Subject to any disclaimer, the term of this patent is extended or adjusted under 35 U.S.C. 154(b) by 0 days.

(21) Appl. No.: 19/223,269

(22) Filed: May 30, 2025

(65) Prior Publication Data

US 2025/0290524 A1 Sep. 18, 2025

(30) Foreign Application Priority Data

Apr. 11, 2025 (CN) ..... 202520680067.8

(51) Int. Cl.
*F04D 29/58* (2006.01)
*F04D 19/00* (2006.01)
*F04D 25/08* (2006.01)

(52) U.S. Cl.
CPC ..... *F04D 29/5853* (2013.01); *F04D 25/084* (2013.01); *F04D 29/584* (2013.01)

(58) Field of Classification Search
CPC .. F04D 25/084; F04D 25/0673; F04D 19/002; F04D 25/08; F04D 17/06; F04D 29/444; F04D 25/0606; F04D 25/166; F04D 27/00; F04D 29/547; F04D 29/542; F04D 29/584; F04D 29/703; F04D 29/5806; F04D 29/5853; A45D 20/10; F24F 5/0017; F24H 3/0423; F25C 2400/10; F25C 5/22
See application file for complete search history.

(56) References Cited

U.S. PATENT DOCUMENTS 10,299,560 B1 * 5/2019 Nelson ..... A45D 20/12
2008/0237900 A1 * 10/2008 Junkel ..... F24F 5/0035 261/28
2018/0164020 A1 6/2018 Gary et al.
2021/0041157 A1 2/2021 Gary et al.
(Continued)

FOREIGN PATENT DOCUMENTS

CN 218598421 U * 3/2023 ..... F04D 25/084

OTHER PUBLICATIONS

Machine Translation of CN218598421 U [retrieved on Nov. 24, 2025]. Retrieved from: Espacenet. (Year: 2025).*

*Primary Examiner* — Eric J Zamora Alvarez
(74) *Attorney, Agent, or Firm* — Hemisphere Law, PLLC

(57) ABSTRACT

A hand-held refrigeration fan is provided, including a fan head and a hand-held portion. The fan head includes a fan housing, an air duct is formed in the fan housing, and the fan housing is provided with a connecting through hole penetrating through inner and outer sides of the air duct. A conductive member is arranged on an outer surface of the hand-held portion, a refrigeration apparatus is arranged in the hand-held portion, a refrigeration end of the refrigeration apparatus is connected to the conductive member in a heat conduction manner, and a heat dissipation end of the refrigeration apparatus communicates with the air duct after penetrating through the connecting through hole. A conductive sheet is arranged on an outer surface of a hand-held portion, and a refrigeration effect is achieved by the conductive sheet through the operation of a refrigeration apparatus.

10 Claims, 6 Drawing Sheets

(56) References Cited

U.S. PATENT DOCUMENTS

| | | | | |
|---|---|---|---|---|
| 2022/0196035 | A1* | 6/2022 | Numata | F04D 29/424 |
| 2023/0265854 | A1* | 8/2023 | Chen | F04D 19/002<br>416/63 |
| 2024/0068733 | A1 | 2/2024 | Gary et al. | |
| 2025/0027506 | A1* | 1/2025 | Zheng | F04D 25/0693 |

* cited by examiner

HANDHELD REFRIGERATION FAN

TECHNICAL FIELD

The present disclosure relates to the technical field of fans, and in particular to a hand-held refrigeration fan.

BACKGROUND

Fan is a common household appliance in daily life, which is used to cool the air in hot weather, and is widely used due to its practical function, so it has a strong market demand.

Hand-held fan refers to a small fan with a hand-held handle on a fan body. When in use, the fan can be carried around by holding its hand-held handle, and the fan is favored by consumers due to its good portability.

However, after using the hand-held fan for a long time, the consumers often have a hot and moist palm. This poor physiological sensation not only affects usage experience of consumers, but also reduces the cooling effect of the fan. Because the palm of the human body is a part sensitive to temperature perception, its perceived information is about to affect the perception and judgment of the human body after being amplified by cranial nerve. If the palm perceives a stuffy heat, the subconscious mind tends to believe that it is currently in a muggy environment, and when the palm perceives cool, the subconscious mind tends to believe that it is currently in a cool environment. Therefore, how to improve the poor physiological sensation formed after holding the hand-held fan for a long time is particularly important for improving usage effect of the hand-held fan.

SUMMARY

An objective of the present disclosure is to provide a hand-held refrigeration fan, a conductive sheet is arranged on an outer surface of the hand-held portion, a refrigeration effect can be achieved by the conductive sheet through an operation of a refrigeration apparatus. When a consumer holds and uses the fan, instead of forming a stuffy feeling, a cooling effect of the fan can be improved through palm refrigeration. In addition, heat generated by a cold-hot semiconductor can be dissipated in time by using a high-speed airflow passing through the air duct, and heat accumulation can be avoided, which can save manufacturing cost of a heat dissipation mechanism and effectively save manufacturing cost of the refrigeration fan.

To achieve the objective above, the present disclosure provides the following technical solution, a hand-held fan includes a fan head, and a hand-held portion integrally connected to the fan head. The fan head includes a fan housing, an air duct is formed in the fan housing, the fan housing is provided with a connecting through hole penetrating through inner and outer sides of the air duct, a conductive member is arranged on an outer surface of the hand-held portion, and a refrigeration apparatus is arranged in the hand-held portion. The refrigeration apparatus includes a refrigeration end and a heat dissipation end, the refrigeration end of the refrigeration apparatus is connected to the conductive member in a heat conduction manner, and the heat dissipation end of the refrigeration end penetrates through the connecting through hole and communicates with the air duct.

Preferably, the heat dissipation end of the refrigeration apparatus protrudes from an inner wall surface of the air duct.

Preferably, the refrigeration apparatus includes a heat sink and a cold-hot semiconductor. A refrigeration end of the cold-hot semiconductor is connected to the conductive member in a heat conduction manner, a heating end of the cold-hot semiconductor is connected to the heat sink in a heat conduction manner, and the heat sink penetrates through the connecting through hole.

Preferably, the refrigeration apparatus is arranged at one end, connected to the fan head, of the hand-held portion, the heat dissipation end of the refrigeration apparatus protrudes from an end surface of the hand-held portion, and the hand-held portion is integrally connected to the fan head by a connector.

Preferably, the connector is an annular ferrule, the annular ferrule is sleeved on a circumferential direction of the heat dissipation end of the refrigeration apparatus, a lower end of the annular ferrule is fixedly connected to the hand-held portion, and an upper end of the annular ferrule is fixedly connected to the fan head.

Preferably, the conductive member is an L-shaped component, a short arm portion of the L-shaped component extends into the hand-held portion from an outer side of the hand-held portion and is connected to the refrigeration apparatus in a heat conduction manner, and a long arm portion of the L-shaped component is attached to the outer surface of the hand-held portion and extends in a length direction of the hand-held portion.

Preferably, an insulation gasket is arranged between the short arm portion of the L-shaped component and a housing of the hand-held portion.

Preferably, the hand-held portion includes a hand-held front housing and a hand-held rear housing engaged with each other, a cavity is formed between the hand-held front housing and the hand-held rear housing, a circuit board assembly and a storage battery are mounted in the cavity, the storage battery is electrically connected to the circuit board assembly, a control key and an USB (universal serial bus) interface are electrically connected to the circuit board assembly, and the control key and the USB interface are both arranged in a preset through hole of the housing of the hand-held portion and extend out from the through hole.

Preferably, the fan housing is provided with an air inlet and an air outlet, the air inlet and the air outlet both communicate with the air duct, an internal bracket is arranged in the air duct, a motor base is disposed on one side, facing the air outlet, of the internal bracket, an air-driving blade group is mounted on the motor base, and the air-driving blade group is used to guide air at the air inlet to be blown out from the air outlet after passing through the air duct.

Preferably, the internal bracket is arranged at an inner side of the air outlet, a device accommodation cavity is disposed on one side, away from the motor base, of the internal bracket, a display screen is mounted in the device accommodation cavity, a cavity opening of the device accommodation cavity is encapsulated with a light-diffusing cover, and displayed content of the display screen can be displayed to the outside through the light-diffusing cover.

Compared with the prior art, the present disclosure has beneficial effects as follows:

a conductive sheet is arranged on an outer surface of the hand-held portion, and a refrigeration effect can be achieved by the conductive sheet through an operation of a refrigeration apparatus. When a consumer holds and uses the fan, instead of forming a stuffy feeling, a cooling effect of the fan can be improved through palm refrigeration. In addition, heat generated by a cold-hot semiconductor can be dissipated in time by using a high-speed airflow passing through the air duct, and heat accumulation can be avoided, which can save manufacturing cost of a heat dissipation mechanism and effectively save manufacturing cost of the refrigeration fan.

Figure 1:
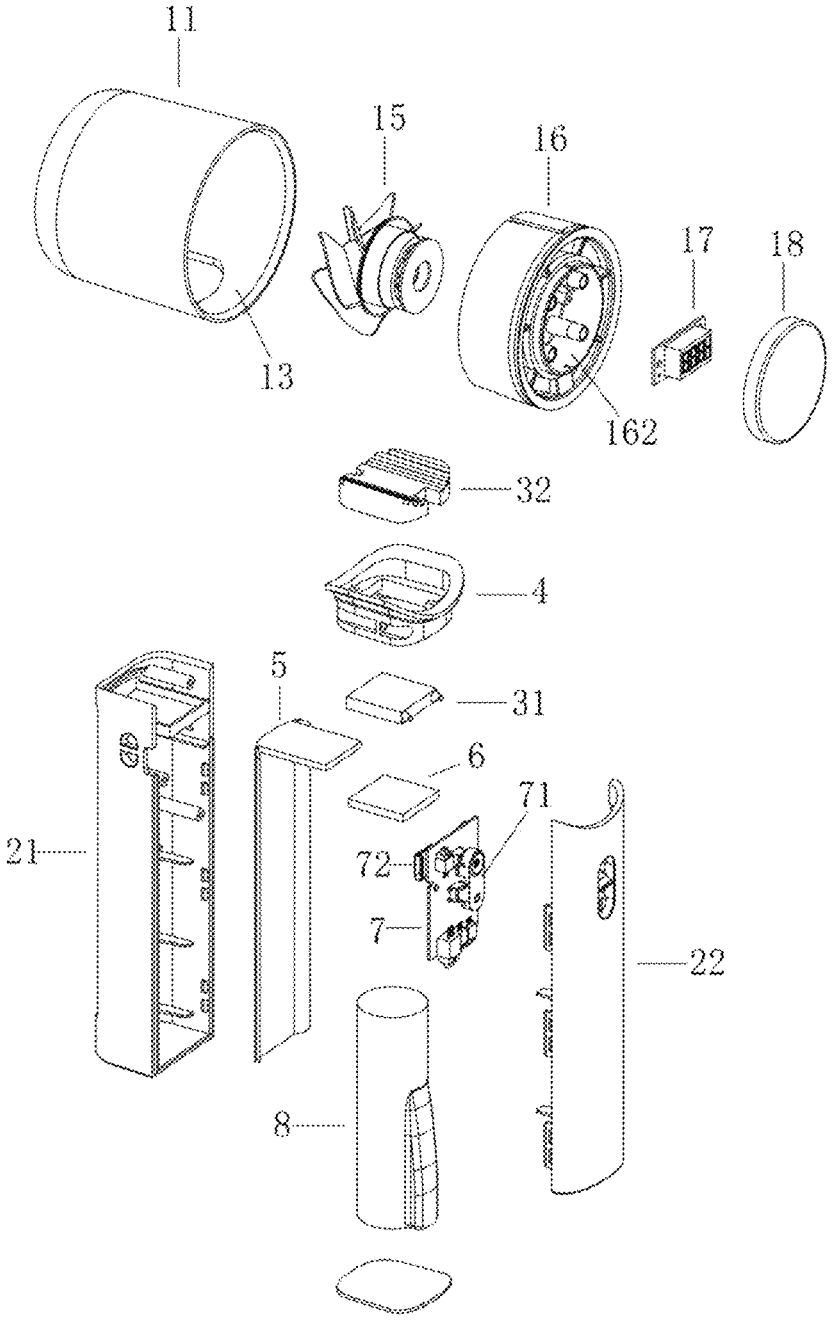
FIG. 1 is a first exploded view of a structure according to the present disclosure.

In the drawings: 1—fan head; 11—fan housing; 12—air inlet; 13—air outlet; 14—connecting through hole; 15—air-driving blade group; 16—internal bracket; 161—motor base; 162—device accommodation gravity; 17—display screen; 18—light-diffusing cover; 2—hand-held portion; 21—handheld front housing; 22—handheld rear housing; 3—refrigeration apparatus; 31—cold-hot semiconductor; 32—heat sink; 4—connector; 5—conductive member; 6—insulation gasket; 7—circuit board assembly; 71—control key; 72—USB interface; 8—storage battery.

DETAILED DESCRIPTION OF THE EMBODIMENTS

The following clearly and completely describes the technical solutions in embodiments of the present disclosure with reference to the accompanying drawings in the embodiments of the present disclosure. Apparently, the described embodiments are merely a part rather than all of the embodiments of the present disclosure. All other embodiments obtained by those of ordinary skill in the art based on the embodiments of the present disclosure without creative efforts shall fall within the scope of protection of the present disclosure.

Figure 2:
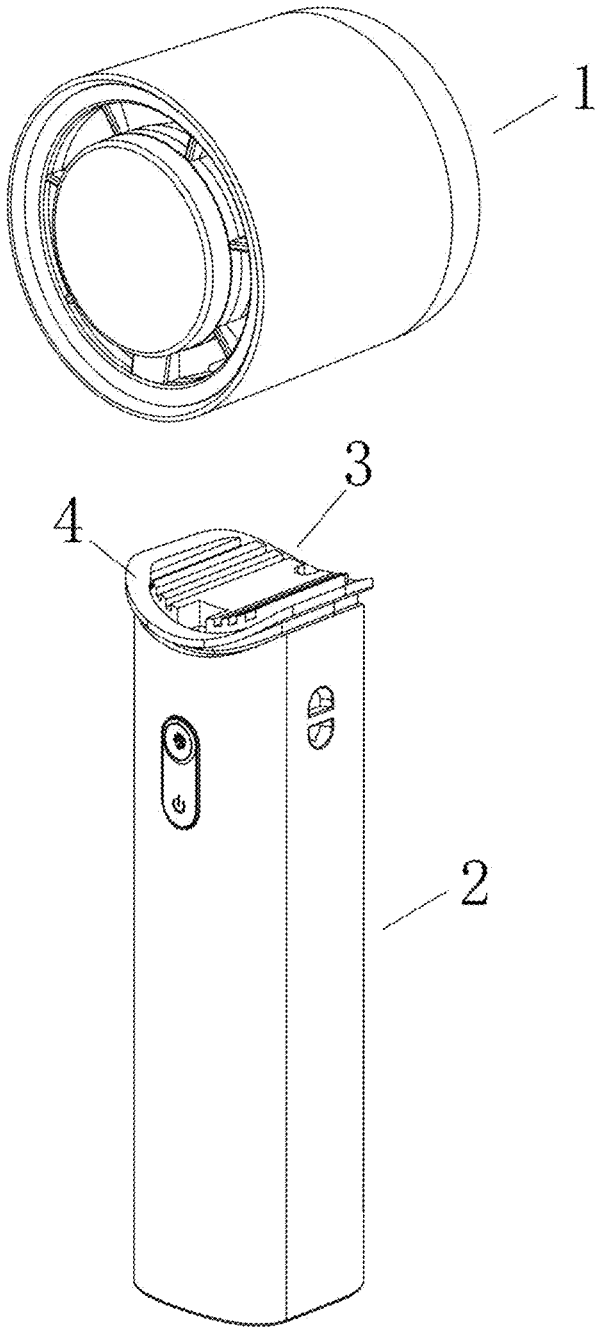
FIG. 2 is a second exploded view of a structure according to the present disclosure.
Figure 3:
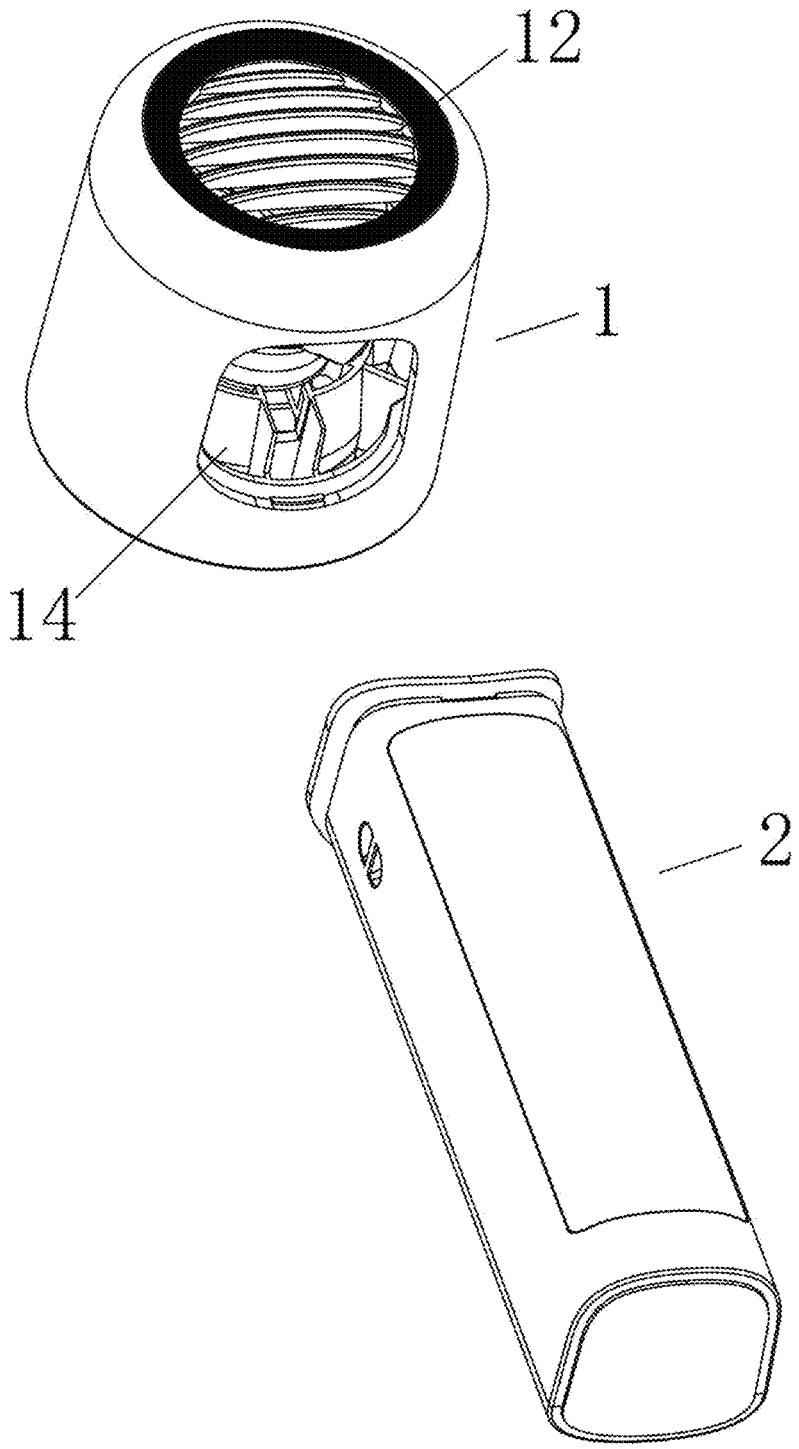
FIG. 3 is a third exploded view of a structure according to the present disclosure.
Figure 4:
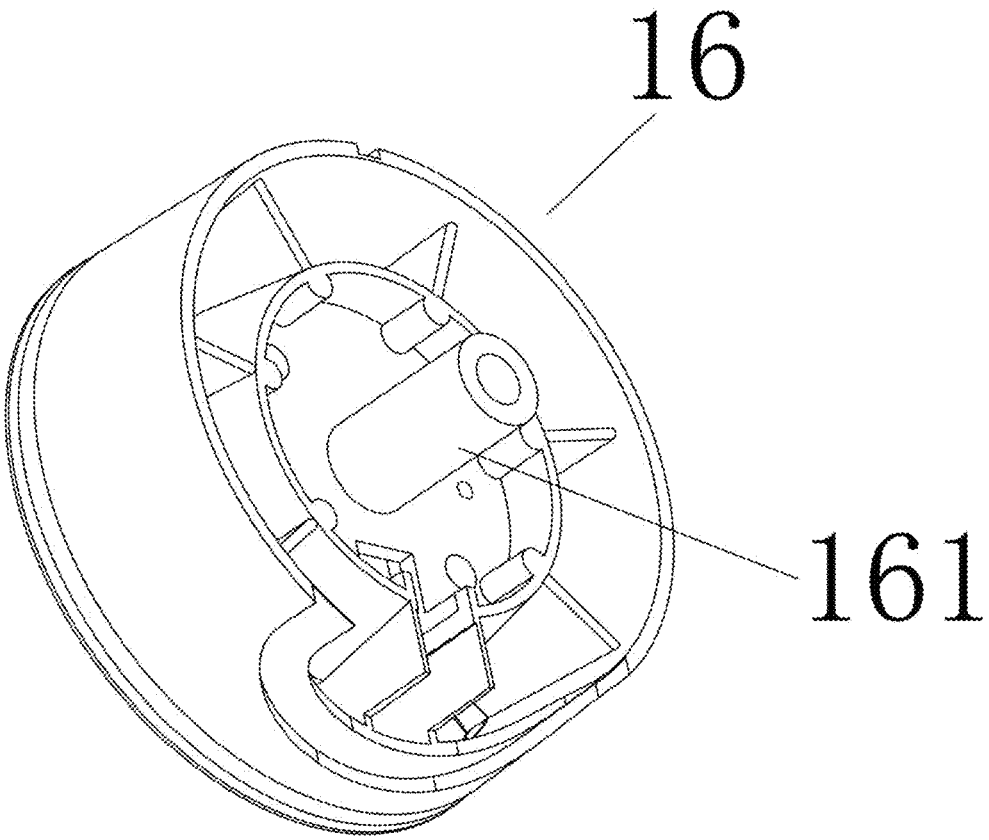
FIG. 4 is a diagram of a structure of an internal bracket according to the present disclosure.
Figure 5:
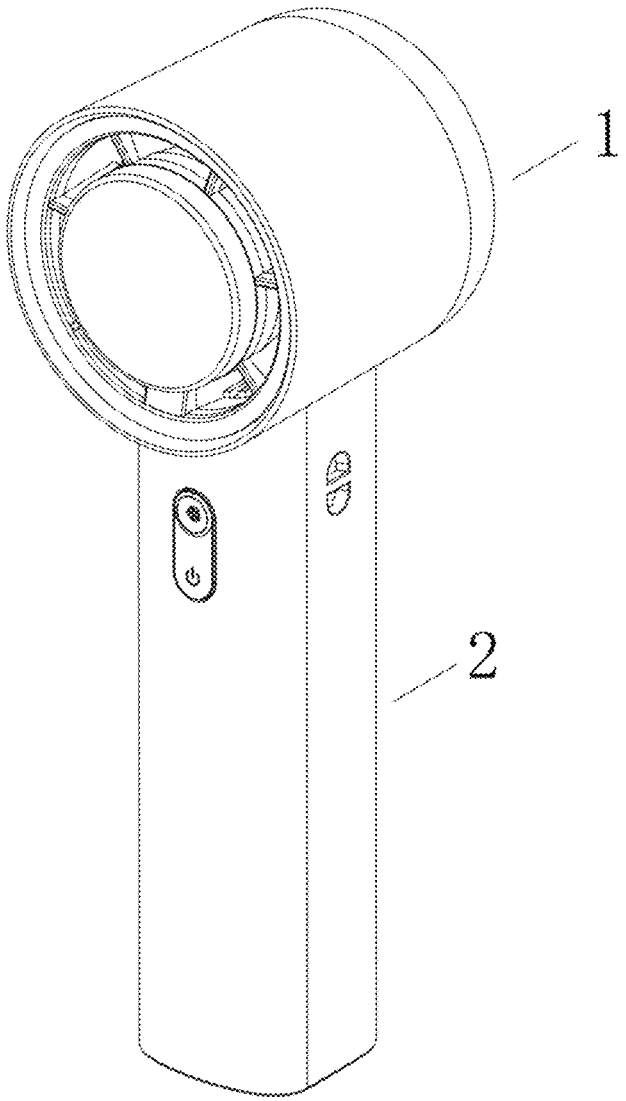
FIG. 5 is a first diagram of a structure according to the present disclosure.
Figure 6:
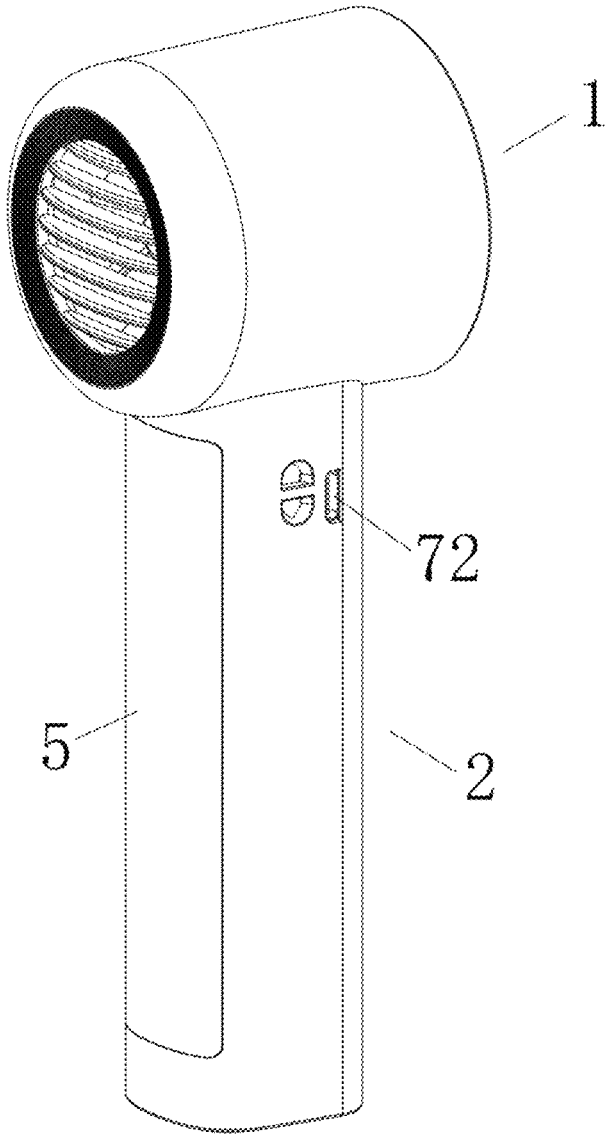
FIG. 6 is a second diagram of a structure according to the present disclosure.

With reference to FIG. 1 to FIG. 6, a hand-held refrigeration fan includes a fan head 1 and a hand-held portion 2 integrally connected to the fan head 1. The fan head 1 includes a fan housing 11, an air duct is formed in the fan housing 11, and the fan housing 11 is provided with a connecting through hole 14 penetrating through inner and outer sides of the air duct. A conductive member 5 is arranged on an outer surface of the hand-held portion 2, and refrigeration apparatus 3 is arranged in the hand-held portion 2. The refrigeration apparatus 3 includes a refrigeration end and a heat dissipation end, the refrigeration end of the refrigeration apparatus 3 is connected to the conductive member 5 in a heat conduction manner, the refrigeration apparatus 3 includes a heat sink 32 and a cold-hot semiconductor 31, a refrigeration end of the cold-hot semiconductor 31 is connected to the conductive member 5 in a heat conduction manner, a heating end of the cold-hot semiconductor 31 is connected to the heat sink 32 in a heat conduction manner, the heat sink 32 at the heat dissipation end of the refrigeration apparatus 3 penetrates through the connecting through hole 14, and communicates with the air duct. The heat sink 32 protrudes from an inner wall surface of the air duct. As heat generated by the heat sink 32 can be taken away in time by a high-speed airflow, heat accumulation at the heat sink 32 can be avoided. Although the high-speed airflow operates to dissipate heat, a heat value carried by its unit flow is low. Therefore, when the airflow acts on the human body, the human body can hardly feel the existence of heat, so that the normal blowing effect of the fan cannot be affected.

The refrigeration apparatus 3 is arranged at one end, connected to the fan head 1, of the hand-held portion 2, the heat dissipation end of the refrigeration apparatus 3 protrudes from an end surface of the hand-held portion 2, the hand-held portion 2 is integrally connected to the fan head 1 through a connector 4. The connector 4 is an annular ferrule, the annular ferrule is sleeved on a circumferential direction of the heat dissipation end of the refrigeration apparatus 3, a lower end of the annular ferrule is fixedly connected to the hand-held portion 2, and an upper end of the annular ferrule is fixedly connected to the fan head 1.

The conductive member 5 is an L-shaped component, a short arm portion of the L-shaped component extends into the hand-held portion 2 from an outer side of the hand-held portion 2 and then is connected to the refrigeration apparatus 3 in a heat conduction manner, a long arm portion of the L-shaped component is attached to the outer surface of the hand-held portion 2, and extends in a length direction of the hand-held portion 2. An insulation gasket 6 is arranged between the short arm portion of the L-shaped component and a housing of the hand-held portion 2, and the insulation gasket 6 is used to prevent a refrigeration effect on the conductive member 5 from being conducted to the housing of the hand-held portion 2 to form energy loss.

The fan housing 11 is provided with an air inlet 12 and an air outlet 13, the air inlet 12 and the air outlet 13 both communicate with the air duct, an internal bracket 16 is arranged in the air duct, and a motor base 161 is disposed on one side, facing the air outlet 12, of the internal bracket 16. An air-driving blade group 15 is mounted on the motor base 161, and the air-driving blade group 15 is configured to guide air at the air inlet 12 to be blown out from the air outlet 13 after passing through the air duct. The internal bracket 16 is arranged at an inner side of the air outlet 13, one side, away from the motor base 161, of the internal bracket 16 is provided with a device accommodation cavity 162, a display screen 17 is mounted in the device accommodation cavity 162, a cavity opening of the device accommodation cavity 162 is encapsulated with a light-diffusing cover 18, and displayed content of the display screen 17 can be displayed to the outside through the light-diffusing cover 18. The display screen 17 is configured to display an operating mode and an operating state of the air-driving blade group 15, and/or the refrigeration apparatus 3, or remaining capacity of the storage battery 8. The hand-held portion 2 includes a hand-held front housing 21 and a hand-held rear housing 22 engaged with each other, a cavity is formed between the hand-held front housing 21 and the hand-held rear housing 22, a circuit board assembly 7 and a storage battery 8 are mounted in the cavity, the storage battery 8 is electrically connected to the circuit board assembly 7, a control key 71 and an USB interface 72 are electrically connected to the circuit board assembly 7, and the control key 71 and the USB interface 72 are both arranged in a preset through hole of the housing of the hand-held portion and extend out from the through hole. The control key 71 is configured to regulate operating states and operating modes of the refrigeration apparatus 3 and the air-driving blade group 15, and the USB interface 72 can charge the storage battery 8 when electrically connected to an external power supply by a charging cable.

In conclusion, the conductive sheet 5 is arranged on the outer surface of the hand-held portion 2, and the refrigeration effect can be achieved by the conductive sheet 5 through an operation of the refrigeration apparatus 3. When a consumer holds and uses the fan, instead of forming a stuffy feeling, a cooling effect of the fan can be improved through palm refrigeration. In addition, heat generated by the cold-hot semiconductor 31 can be dissipated in time by using a high-speed airflow passing through the air duct, and heat accumulation can be avoided, which can save manufacturing cost of a heat dissipation mechanism and effectively save manufacturing cost of the refrigeration fan.

It should be noted that relational terms such as first and second herein are only used to distinguish one entity or operation from another entity or operation without necessarily requiring or implying any such actual relationship or order between these entities or operations. Moreover, the terms "including", "containing" or any other variation thereof are intended to cover non-exclusive inclusion, so that a process, method, commodity or device including a series of elements includes not only those elements, but also other elements not explicitly listed, or elements inherent to such a process, method, commodity or device.

Although the embodiments of the present disclosure have been shown and described, those skilled in the art should appreciate that many changes, modifications, substitutions and variations can be made to these embodiments without departing from the principles and spirits of the present disclosure, and the scope of the present disclosure is defined by the claims and their equivalents.

What is claimed is:

1. A hand-held refrigeration fan, comprising a fan head (1), and a hand-held portion (2) integrally connected to the fan head (1), wherein the fan head (1) comprises a fan housing (11), an air duct is formed in the fan housing (11), the fan housing (11) is provided with a connecting through hole (14) penetrating through inner and outer sides of the air duct, a conductive member (5) is arranged on an outer surface of the hand-held portion (2), a refrigeration apparatus (3) is arranged in the hand-held portion (2), the refrigeration apparatus (3) comprises a refrigeration end and a heat dissipation end, the refrigeration end of the refrigeration apparatus (3) is connected to the conductive member (5), and the heat dissipation end of the refrigeration end (3) penetrates through the connecting through hole (14) and communicates with the air duct.

2. The hand-held refrigeration fan according to claim 1, wherein the heat dissipation end of the refrigeration apparatus (3) protrudes from an inner wall surface of the air duct.

3. The hand-held refrigeration fan according to claim 1, wherein the refrigeration apparatus (3) further comprises a heat sink (32), and a cold-hot semiconductor (31), a refrigeration end of the cold-hot semiconductor (31) is connected to the conductive member (5), a heating end of the cold-hot semiconductor (31) is connected to the heat sink (32), and the heat sink (32) penetrates through the connecting through hole (14).

4. The hand-held refrigeration fan according to claim 1, wherein the refrigeration apparatus (3) is arranged at one end, connected to the fan head (1), of the hand-held portion (2), the heat dissipation end of the refrigeration apparatus (3) protrudes from an end surface of the hand-held portion (2), and the hand-held portion (2) is integrally connected to the fan head (1) by a connector (4).

5. The hand-held refrigeration fan according to claim 4, wherein the connector (4) is an annular ferrule, the annular ferrule is sleeved on a circumferential direction of the heat dissipation end of the refrigeration apparatus (3), a lower end of the annular ferrule is fixedly connected to the hand-held portion (2), and an upper end of the annular ferrule is fixedly connected to the fan head (1).

6. The hand-held refrigeration fan according to claim 1, wherein the conductive member (5) is an L-shaped component, a short arm portion of the L-shaped component extends into the hand-held portion (2) from an outer side of the hand-held portion (2) and is connected to the refrigeration apparatus (3), and a long arm portion of the L-shaped component is attached to the outer surface of the hand-held portion (2) and extends in a length direction of the hand-held portion (2).

7. The hand-held refrigeration fan according to claim 6, wherein an insulation gasket (6) is arranged between the short arm portion of the L-shaped component and a housing of the hand-held portion (2).

8. The hand-held refrigeration fan according to claim 1, wherein the hand-held portion (2) comprises a hand-held front housing (21) and a hand-held rear housing (22) engaged with each other, a cavity is formed between the hand-held front housing (21) and the hand-held rear housing (22), a circuit board assembly (7) and a storage battery (8) are mounted in the cavity, the storage battery (8) is electrically connected to the circuit board assembly (7), a control key (71) and an USB (universal serial bus) interface (72) are electrically connected to the circuit board assembly (7), and the control key (71) and the USB interface (72) are each arranged in a corresponding preset through hole of the hand-held portion and extend out from the corresponding through hole.

9. The hand-held refrigeration fan according to claim 1, wherein the fan housing (11) is provided with an air inlet (12) and an air outlet (13), the air inlet (12) and the air outlet (13) both communicate with the air duct, an internal bracket (16) is arranged in the air duct, a motor base (161) is disposed on one side, facing the air outlet (12), of the internal bracket (16), an air-driving blade group (15) is mounted on the motor base (161), and the air-driving blade group (15) is used to guide air at the air inlet (12) to be blown out from the air outlet (13) after passing through the air duct.

10. The hand-held refrigeration fan according to claim 9, wherein the internal bracket (16) is arranged at an inner side of the air outlet (13), a device accommodation cavity (162) is disposed on one side, away from the motor base (161), of the internal bracket (16), a display screen (17) is mounted in the device accommodation cavity (162), a cavity opening of the device accommodation cavity (162) is encapsulated with a light-diffusing cover (18), and displayed content of the display screen (17) is able to be displayed to the outside through the light-diffusing cover (18).

* * * * *